US005692946A

United States Patent [19]

Ku

[11] Patent Number: 5,692,946

[45] Date of Patent: Dec. 2, 1997

[54] SPHERICAL STEERING TOY

[76] Inventor: Wang-Mine Ku, P.O. Box 82-144, Taipei, Taiwan

[21] Appl. No.: 583,818

[22] Filed: Jan. 11, 1996

[51] Int. Cl.[6] ..... A63H 30/04

[52] U.S. Cl. ..... 446/456; 446/460; 446/462; 273/58 G

[58] Field of Search ..... 446/431, 441, 446/445, 454–456, 460–462, 437; 273/58 G

[56] References Cited

U.S. PATENT DOCUMENTS

| | | | |
|---|---|---|---|
| 3,500,579 | 3/1970 | Bryer | 446/437 |
| 4,501,569 | 2/1985 | Clark, Jr. et al. | 446/456 |
| 4,541,814 | 9/1985 | Martin | 446/456 |
| 4,927,401 | 5/1990 | Sonesson | 446/456 |
| 5,041,051 | 8/1991 | Sonesson | 446/456 |
| 5,439,408 | 8/1995 | Wilkenson | 446/456 |

FOREIGN PATENT DOCUMENTS

| | | | |
|---|---|---|---|
| 8803308 | 6/1988 | Germany | 446/456 |

*Primary Examiner*—Robert A. Hafer
*Assistant Examiner*—Jeffrey D. Carlson
*Attorney, Agent, or Firm*—Alfred Lei

[57] ABSTRACT

A spherical steering toy including a spherical housing, a mounting plate mounted inside the spherical housing and having wheels maintained perpendicularly in touch with the inside wall of the spherical housing, a servo-motor having an output shaft fastened to the center of the mounting plate by a screw, a driving mechanism coupled to the servo-motor at one side opposite to the crossed frame, which driving mechanism including a reversible motor, a transmission gear train, and a wheel coupled to the reversible motor through the transmission gear train and rotated by it against the inside wall of the spherical housing, and a control circuit controlled by a remote controller to operate the servo-motor and the reversible motor, wherein starting the reversible motor causes the spherical housing to rotate forwards and backwards on a flat surface; starting the servo-motor causes the spherical housing to change the steering direction.

5 Claims, 6 Drawing Sheets

SPHERICAL STEERING TOY

BACKGROUND OF THE INVENTION

1. Field of the Invention

The present invention relates to a spherical steering toy which is controlled by a remote controller to move on flat surface.

2. Description of the Prior Art

A variety of TV game machines and motor-driven toys have been disclosed for children to play with, and have appeared on the market. However, regular motor-driven toys can only be controlled to move the moving parts in a pre-determined course repeatedly. Therefore, these toys do not interest children for long.

SUMMARY OF THE INVENTION

This invention relates to a spherical steering toy.

The present invention has been accomplished to provide a spherical steering toy which can be controlled to steer on a flat surface through the control of a remote controller. According to the present invention, the spherical steering toy comprises a spherical housing, a mounting plate mounted inside the spherical housing and having wheels maintained perpendicularly in touch with the inside wall of the spherical housing, a servo-motor having an output shaft fastened the center of the mounting plate by a screw, a driving mechanism coupled to the servo-motor at one side opposite to the crossed frame, which driving mechanism comprising a reversible motor, a transmission gear train, and a wheel coupled to the reversible motor through the transmission gear train and rotated by it against the inside wall of the spherical housing, and a control circuit controlled by a remote controller to operate the servo-motor and the reversible motor, wherein starting the reversible motor causes the spherical housing to rotate forwards and backwards on a flat surface; starting the servo-motor causes the spherical housing to change the steering direction.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
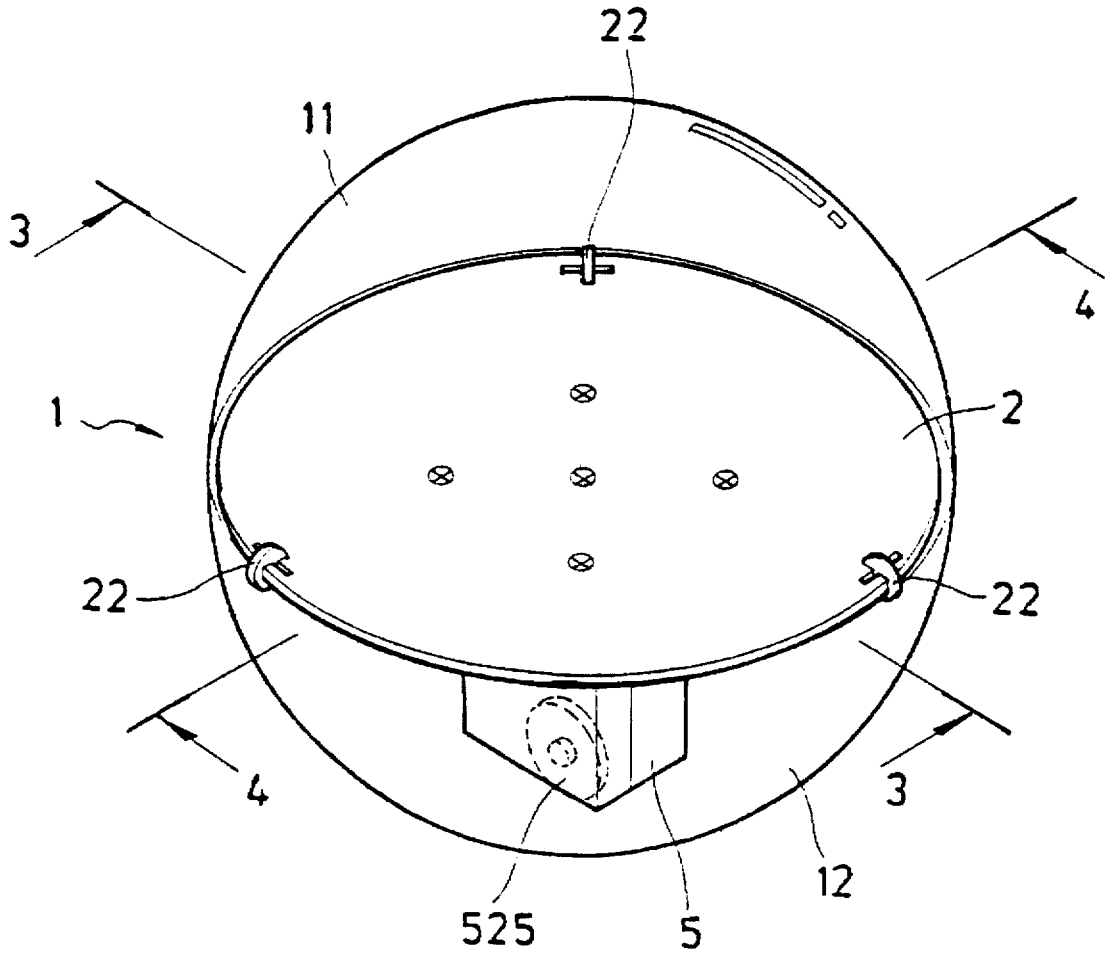
FIG. 1 is a perspective view of a spherical steering toy according to the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
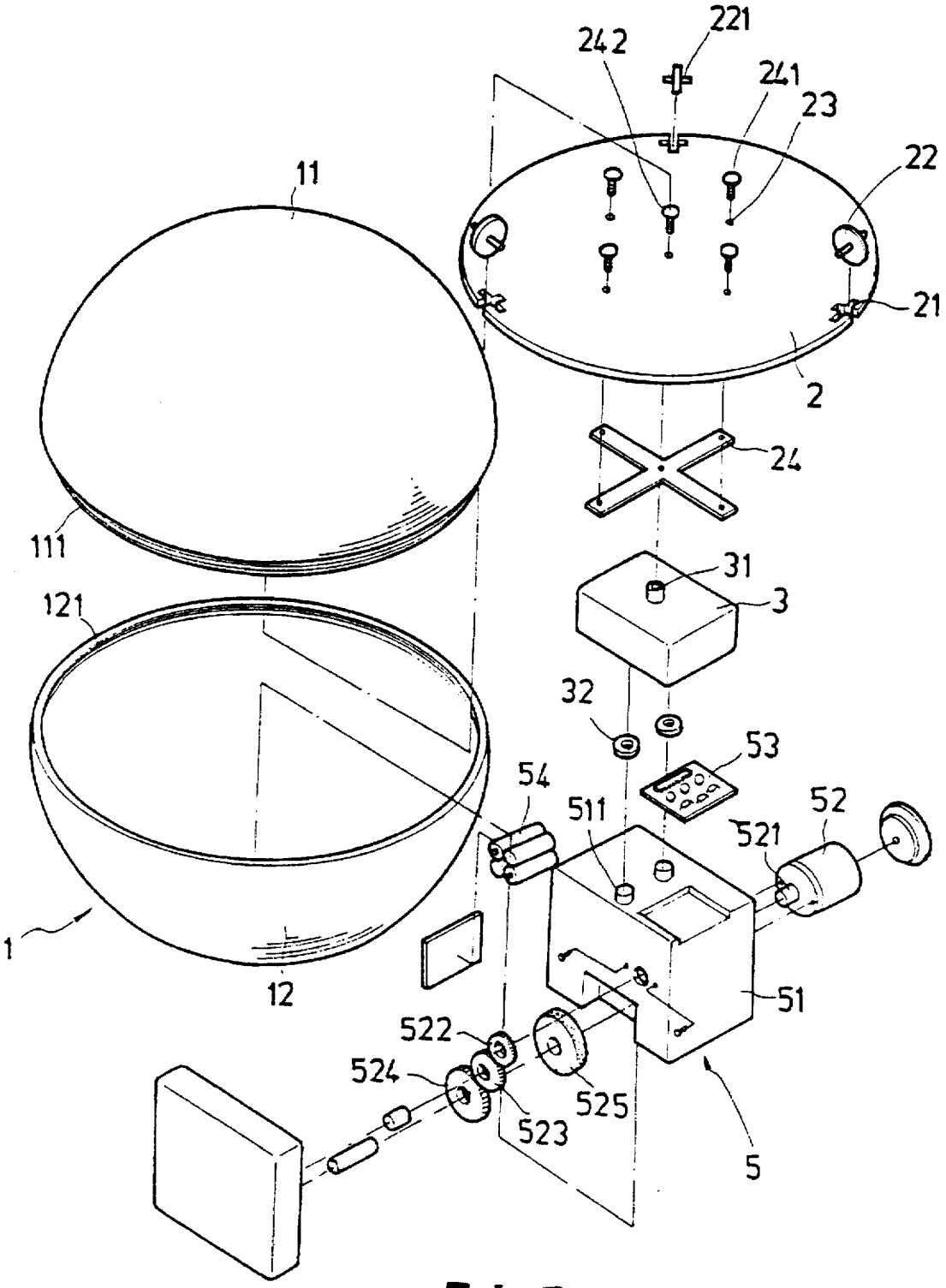
FIG. 2 is an exploded view of the spherical steering toy shown in FIG. 1.

Referring to FIGS. 1 and 2, a spherical steering toy in accordance with the present invention comprises a spherical housing 1 consisting of a first semi-spherical shell 11, which has an outer thread 111 around the periphery, and a second semi-spherical shell 12, which has an inner thread 121 around the periphery screwed up with the outer thread 111 of the first semi-spherical shell 11. A mounting plate 2 is mounted inside the spherical housing 1 and retained between the first semi-spherical she11 11 and the second semi-spherical shell 12, having a plurality of crossed slots 21 around the periphery for mounting a respective wheel 22 perpendicularly. The wheel 22 has a springy wheel axle 221 fastened to one crossed slot 21. The springy wheel axle 221 is so installed that the respective wheel 22 is maintained closely attached to the inside wall of the spherical housing 1 between the first semi-spherical shell 11 and the second semi-spherical shell 12.

Figure 7:
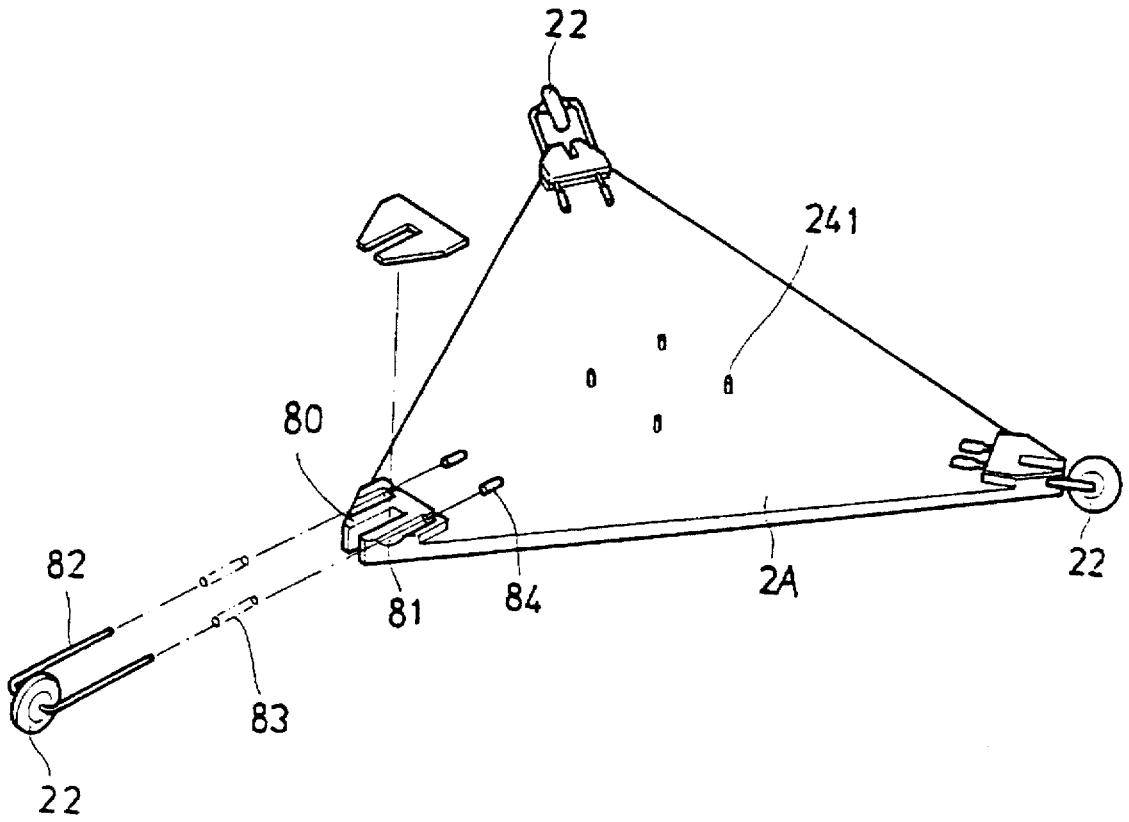
FIG. 7 shows a triangular mounting plate according to the present invention.
Figure 8A:
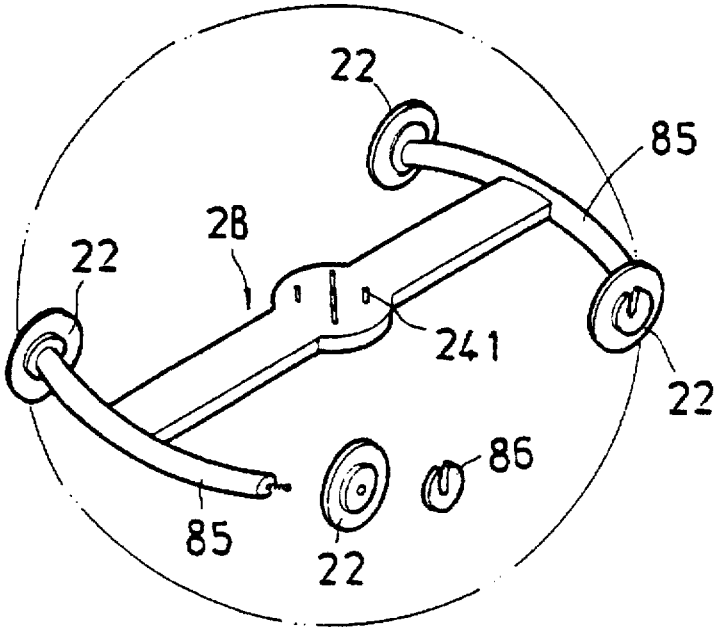
FIG. 8A shows a I-shaped mounting plate according to the present invention.
Figure 8B:
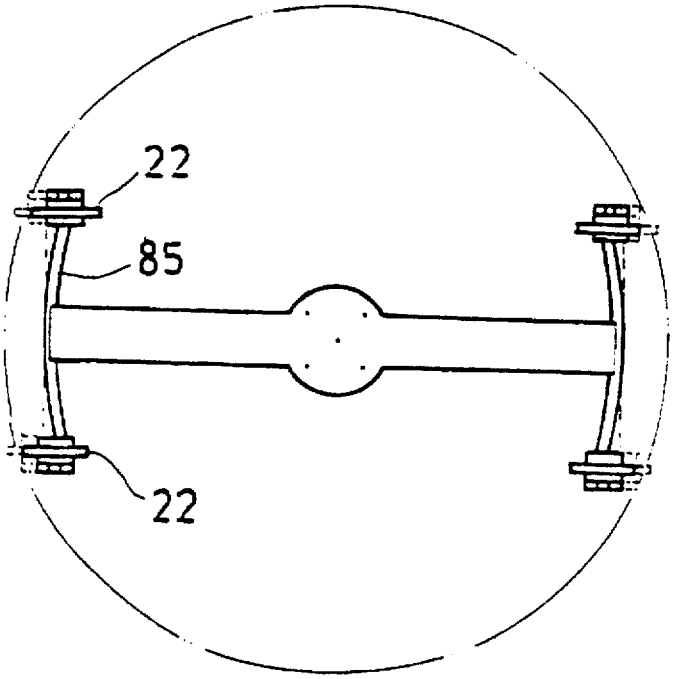
FIG. 8B shows the wheels of the I-shaped mounting plate of FIG. 8A perpendicularly touch the inside wall of the spherical housing.

The aforesaid mounting plate 2 is made of circular shape. As an alternate form of the present invention, the mounting plate can be made of triangular shape. As illustrated in FIG. 7, the mounting plate 2A is made of triangular shape having three wheel holders 80 at each angle respectively and perpendicularly stopped against the inside wall of the spherical housing 1. Each wheel holder 80 comprises two parallel through holes 81. A substantially U-shaped springy wheel axle 82 is fastened to each wheel holder 80 to hold a respective wheel 22. The wheel axle 82 has two opposite ends respectively inserted through a respective coiled spring 83, then into each through hole 81, and then fastened with a respective end cap 84. FIGS. 8A and 8B show another alternate form of the mounting plate. As illustrated in FIG. 8A, the mounting plate 2B is a substantially I-shaped frame having two smoothly curved cross bars 85 at two opposite ends, and two pairs of wheels 22 respectively mounted on two opposite ends of each cross bar 85 and fixed in place by clamps 86. The mounting plate 2B is molded from resilient plastics. When installed, the wheels 22 are springily maintained in touch with the inside wall of the spherical housing 1 (see FIG. 8B).

Referring to FIG. 2 again, the mounting plate 2 has a plurality of through holes 23 around the center. A crossed frame 24 is fastened to the through holes 23 of the mounting plate 2 at one side by screws 241 to hold a servo-motor 3 and a driving mechanism 5. The servo-motor 3 is mounted on the driving mechanism 5 at the top, having an upright output shaft 31 perpendicularly fixed to the center of the crossed frame 24 and the center of the mounting plate 2 by a screw 242. The driving mechanism 5 comprises a casing 51 having upright mounting rods 51 at the top respectively mounted with a respective rubber cushion 32 to hold the servo-motor 3 in place, a reversible motor 52 inside the casing 51, a gear train 522, 523, 524 coupled to the output shaft 521 of the reversible motor 52, and a wheel 525 coupled to the gear train 522, 523, 524 and maintained in touch with the inside wall of the spherical housing 1, and a control circuit 53 for controlling the operation of the servo-motor 3 and the reversible motor 52, and a battery 54 connected to the control circuit 53 to provide the servo-motor 3 and the reversible motor 52 with the necessary working voltage. The servo-motor 3 and the reversible motor 52 are arranged at right angles. When the servo-motor 3 is rotated, the spherical housing 1 is forced to rotate in the X-axis (see FIGS. 3 and 4). When the reversible motor 52 is controlled to turn the wheel 525 forwards and backwards, the spherical housing 1 is forced to rotate in the Y-axis (see FIGS. 3 and 4).

Figure 3:
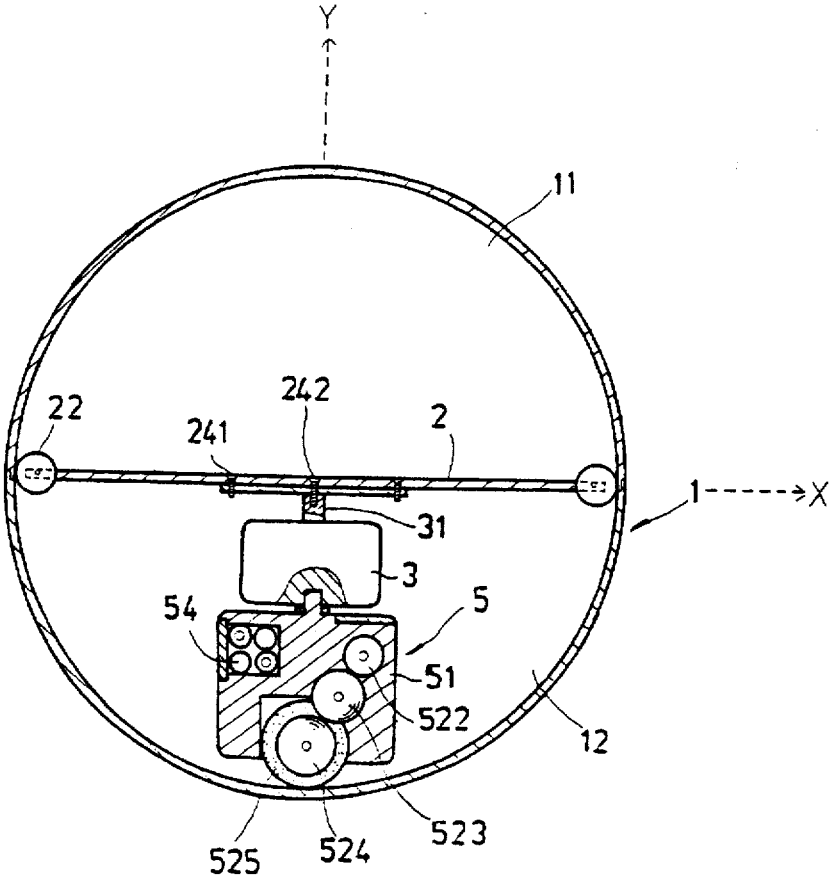
FIG. 3 is a cross sectional view taken along line 3—3 of FIG. 1.

Referring to FIG. 3, the mounting plate 2 passes the center of the spherical housing 1, the wheels 22 and 525 are respectively maintained in touch with the inside wall of the spherical housing 1, and the wheel 525 is disposed in a direction perpendicular to the mounting plate 2. When the wheel 525 is rotated, the center of gravity of the whole moving assembly of the steering spherical toy is maintained unchanged inside the spherical housing 1. Because the wheels 22 are rotated in a direction tangent to the periphery of the spherical housing 1, the spherical housing 1 can be moved smoothly forwards and backwards by rotating the wheels 22.

Figure 4:
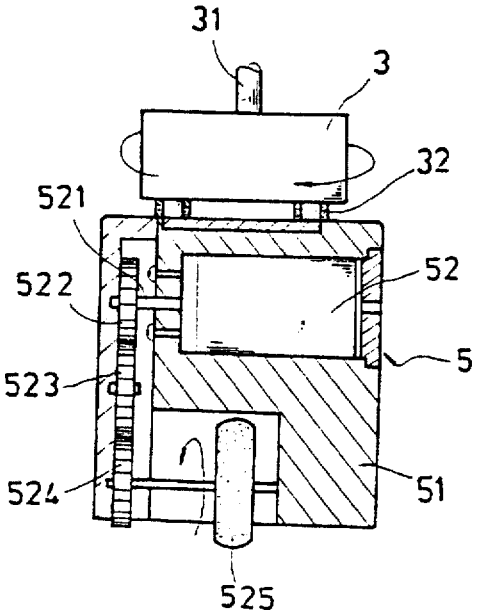
FIG. 4 is a cross sectional view taken along line 4—4 of FIG. 1.

Referring to FIG. 4 and FIG. 3 again, the servo-motor 3 and the reversible motor 52 are arranged at right angles, the output shaft 31 of the servo-motor 3 is fixed to the center of the mounting plate 2. When the servo-motor 3 is started as the wheel 525 is rotated to move the spherical housing 1, the mounting plate 2 cannot be rotated because the wheels 22 are perpendicularly attached to the inside wall of the spherical housing 1, therefore the servo-motor 3 and the driving mechanism 5 are forced to change the angular position relative to the mounting plate 2, causing the spherical housing 1 to change the steering direction. During the operation of the servo-motor 3 and the reversible motor 52, the rubber cushions 32 absorb shock waves to keep the wheel 525 rotated smoothly.

Figure 5:
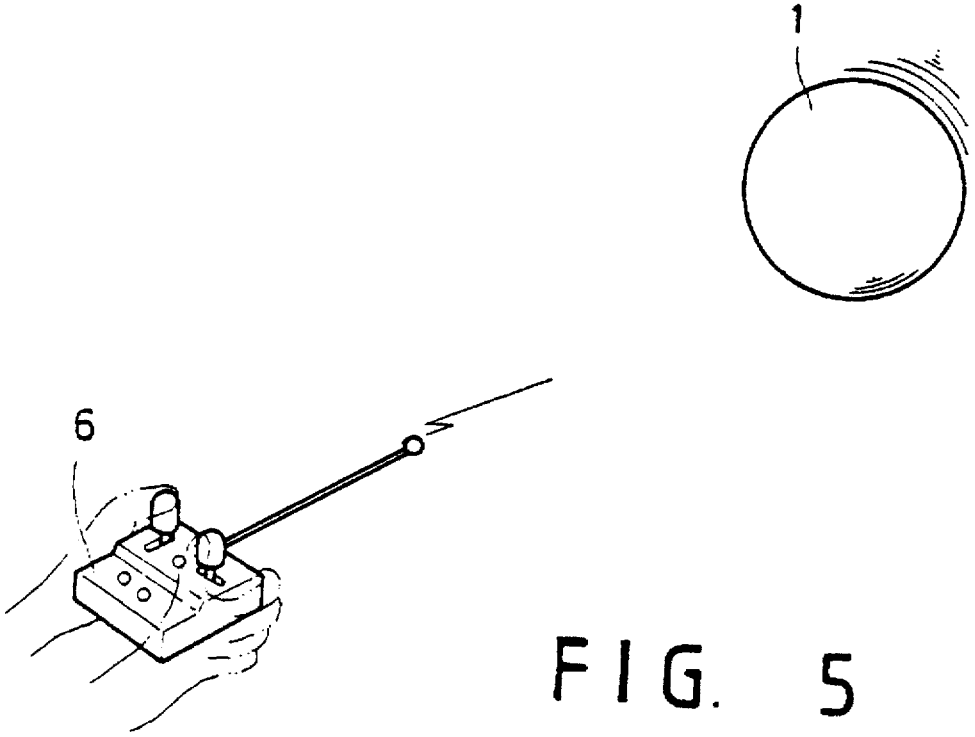
FIG. 5 is an applied view of the present invention, showing the spherical steering toy controlled by a remote controller.

Referring to FIG. 5, through the control of a remote controller 6, the control circuit 53 is driven to control the operation of the servo-motor 3 and the reversible motor 52, and therefore the steering direction of the spherical housing 1 is controlled.

Figure 6:
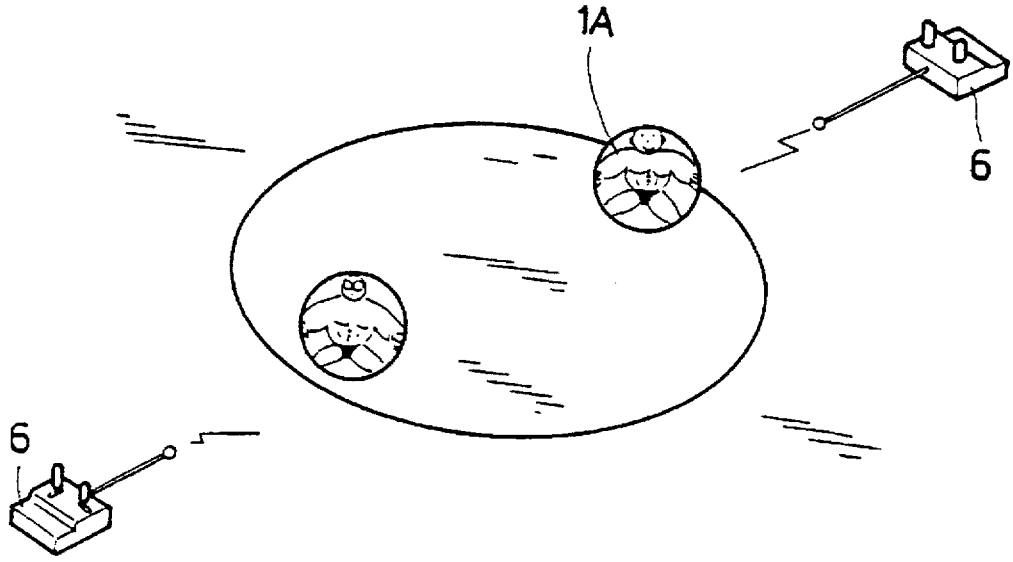
FIG. 6 is another applied view of the present invention, showing two spherical steering toys controlled by two players through a respective remote controller.

Referring to FIG. 6, two spherical steering toys can be put in a defined area and controlled by two players through a respective remote controller 6 to play a bumping game. When the spherical housing 1 or 1A is expelled out of the defined area, the opponent wins the game.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A spherical steering toy comprising:

a spherical housing, said spherical housing comprising two symmetrical semi-spherical shells connected together by a screw joint;

a mounting plate mounted inside said spherical housing, said mounting plate having a plurality of wheels around the border perpendicularly touching the inside wall of said spherical housings;

a crossed frame fixedly secured inside the housing at the centers;

a servo-motor having an output shaft fastened to the center of said crossed frame by a screw;

a driving mechanism coupled to said servo-motor at one side opposite to said crossed frame, said driving mechanism comprising a casing coupled to said servo-motor, a reversible motor mounted inside said casing, a transmission gear train coupled to said reversible motor, and a wheel coupled to said transmission gear train and rotated by it against the inside wall of said spherical housing, said casing of said driving mechanism having a plurality of upright mounting rods mounted with a respective rubber cushion to hold said servo-motor in place;

a control circuit mounted in the casing of said driving mechanism and controlled by a remote controller to operate said servo-motor and said reversible motor; and a battery power supply mounted in the casing of said driving mechanism to provide the necessary working voltage to said control circuit, said servo-motor, and said reversible motor;

wherein starting said reversible motor causes said spherical housing to rotate forwards and backwards on a flat surface; starting said servo-motor causes said spherical housing to change the steering direction.

2. The spherical steering toy as claimed in claim 1, wherein said mounting plate is made of circular shape to hold the respective wheels by springy wheel axles.

3. The spherical steering toy as claimed in claim 1, wherein said mounting plate is made of triangular shape having three wheel holders at each angle to hold a respective wheel by a respective U-shaped wheel axle, each U-shaped wheel axle being supported on the respective wheel holder by spring means.

4. The spherical steering toy as claimed in claim 1, wherein said mounting plate is molded from resilient plastics, having two smoothly curved cross bars at two opposite ends to hold a respective pair of wheels, permitting the wheels to be maintained perpendicularly in touch with the inside wall of said spherical housing.

5. The spherical steering toy as claimed in claim 1, wherein said mounting plate is molded from resilient plastics, having wheels at two opposite ends and two opposite sides respectively and perpendicularly maintained in touch with the inside wall of said spherical housing.

* * * * *